United States Patent [19]

Harper

[11] Patent Number: 4,683,706

[45] Date of Patent: Aug. 4, 1987

[54] APPARATUS AND METHOD FOR INSTALLING LIDS ON CONTAINERS

[75] Inventor: Chester H. Harper, Aurora, Oreg.

[73] Assignee: Allen Furit Co., Inc., Newberg, Oreg.

[21] Appl. No.: 896,808

[22] Filed: Aug. 15, 1986

[51] Int. Cl.[4] ..... B65B 7/28; B67B 3/22

[52] U.S. Cl. ..... 53/485; 53/314; 53/316; 53/367

[58] Field of Search ..... 53/314, 313, 316, 367, 53/485, 487

[56] References Cited

U.S. PATENT DOCUMENTS

| | | | |
|---|---|---|---|
| 1,772,823 | 8/1930 | Anderson | 53/316 X |
| 2,734,673 | 2/1956 | Hazel et al. | 53/314 |
| 3,332,210 | 7/1967 | Tordi | 53/316 |
| 3,350,842 | 11/1967 | Renish | 53/316 |
| 3,938,697 | 2/1976 | Kinney | 53/313 X |
| 4,077,188 | 3/1978 | Strombeck et al. | 53/314 X |
| 4,095,390 | 6/1978 | Knudsen | 53/314 X |
| 4,098,058 | 7/1978 | Carrigan et al. | 53/314 X |
| 4,312,172 | 1/1982 | Fisher et al. | 53/314 X |
| 4,601,160 | 7/1986 | Heisler | 53/316 X |

*Primary Examiner*—Horace M. Culver

*Attorney, Agent, or Firm*—Chernoff, Vilhauer, McClung & Stenzel

[57] ABSTRACT

Apparatus and method for applying resiliently self-latching lids to upwardly open containers such as molded plastic buckets used to contain powdered or liquid products, in which a supply of generally planar circular lids is supported in a shallow sloping stack in which individual lids are on edge and supported on parallel sloping rails. Lids are released individually into a lid placement guide which may include a reciprocally rotating mechanism to orient each lid to place a pour spout of the lid in proper position relative to a bail of the container. Containers are carried beneath the lid placement guide on an endless belt conveyor to receive lids. A powered presser roll forces the lid into mating relationship with each container, without overturning empty containers receiving the lids.

6 Claims, 7 Drawing Figures

FIG. 1
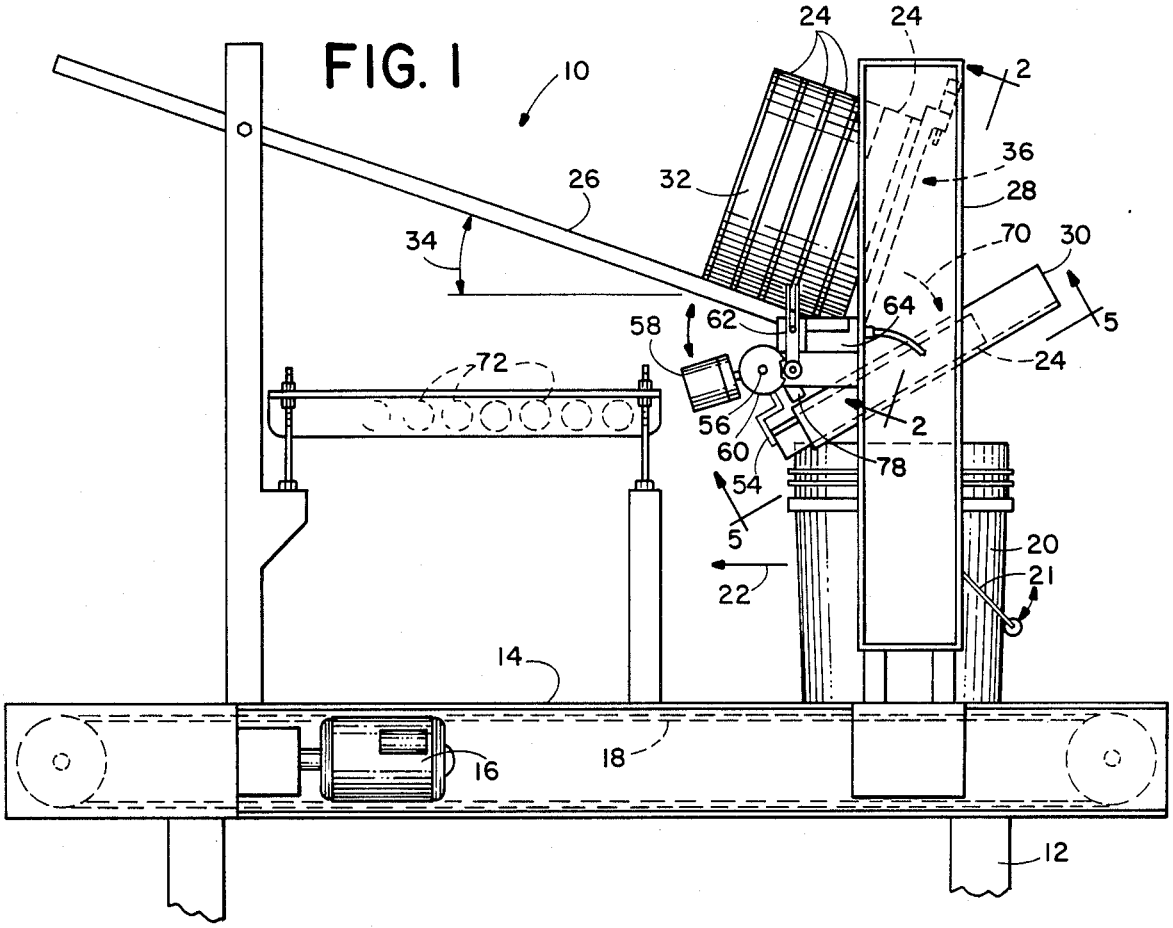
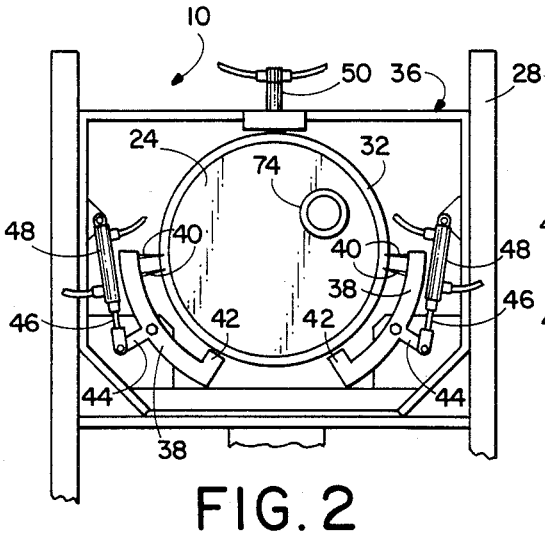
FIG. 2
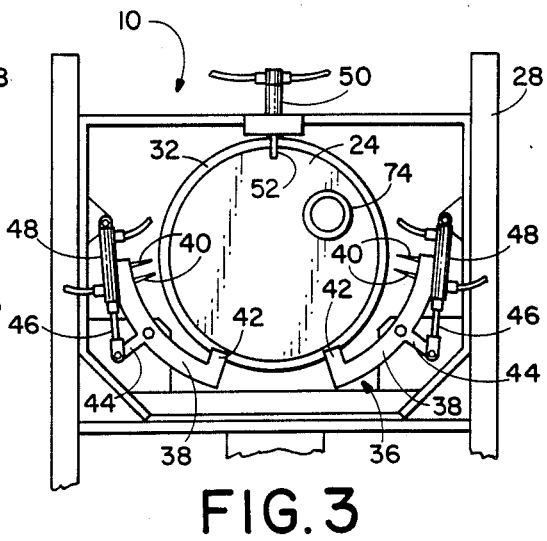
FIG. 3

FIG. 5
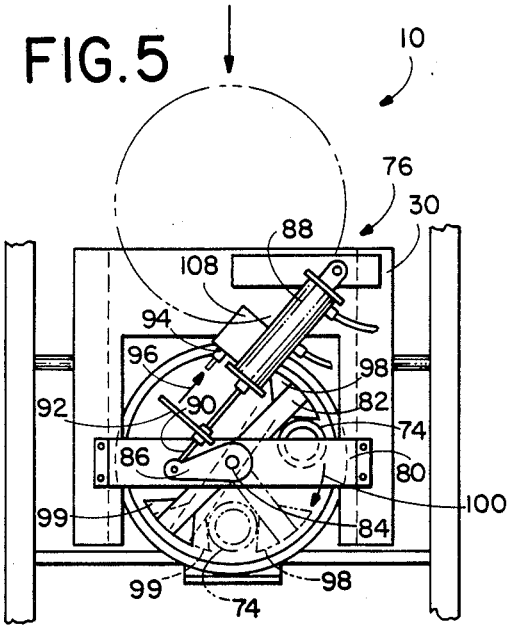
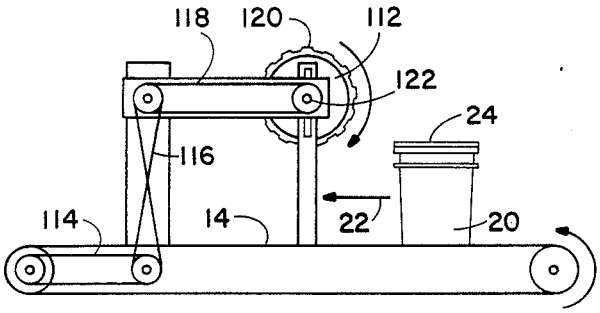
FIG. 7
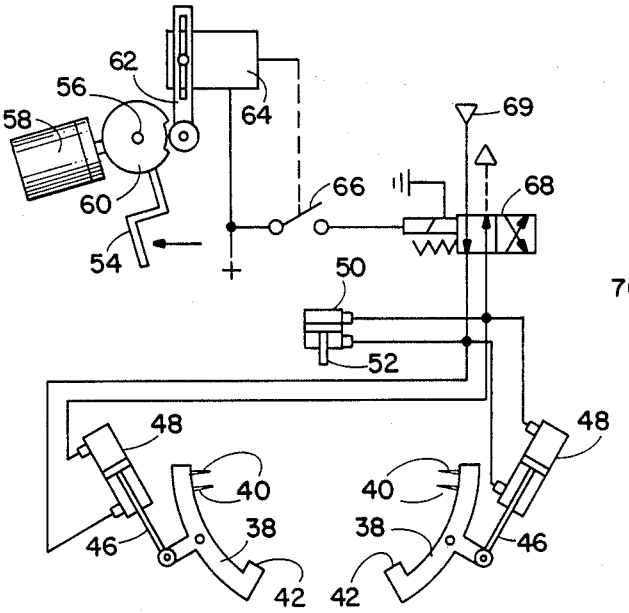
FIG. 4
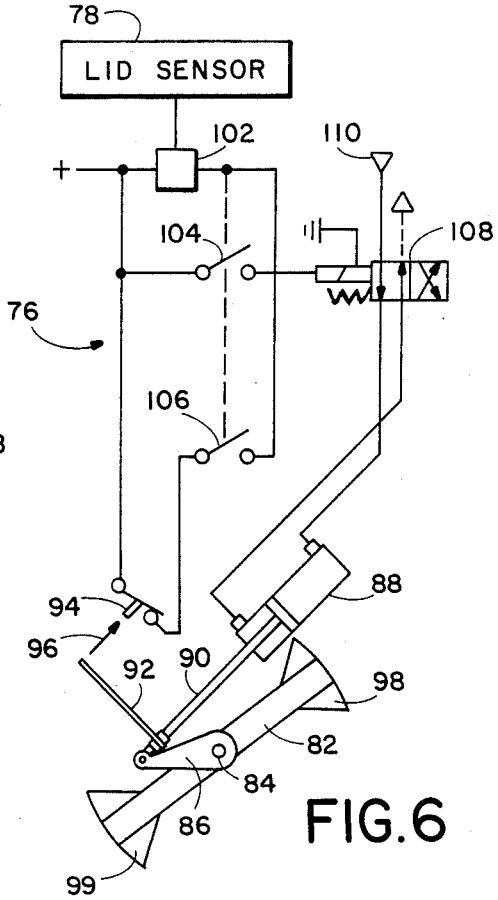
FIG. 6

APPARATUS AND METHOD FOR INSTALLING LIDS ON CONTAINERS

BACKGROUND OF THE INVENTION

The present invention relates to machines for mounting resiliently latching lids on containers, and particularly to a machine for placing circular lids including pouring spouts on such containers in a desired orientation.

Bucket-like containers, usually molded of sturdy plastic material, are widely used to contain powdered or liquid products. A lid is placed on each container, where it is pressed downward into place and thereafter held securely by a latching interaction between the rim of the container and the resilient depending and surrounding rim of the lid. Products may be placed in such containers before application of a lid, or through a pouring spout defined in the lid, after the lid has been attached to the container.

Well-known machinery has previously been available to place lids in position atop such containers as each container moves along on a conveyor. Some difficulty has been encountered in thereafter pressing a lid downward into latching engagement on an empty container. In such previously available machinery freely rotatable rollers located above the conveyor have been used to force the lid downward into its latching position atop a container. The rollers of such previous machinery, however, have often overturned empty containers as the lid encounters the first of the rollers and the bottom of the container continues to be carried along by the conveyor.

Previously available machines dispense lids from a vertical stack into position for being fastened atop a container. Thus, the entire weight of the stack of lids has had to be supported by the dispensing mechanism. This places too much stress on the dispensing mechanism, with the result that dependability of the dispensing mechanism is less than desired, and with the further result that the height of the stack causes undesirable variations in the operation of the dispensing mechanism. Because the weight of a stack of lids is a limiting factor for such machinery, it has previously been necessary to provide lids frequently to replenish the small stack.

When a lid for a container includes a pouring spout, and the container has a bail or handle, the pouring spout portion of the lid must be located properly with respect to the bail or handle in order to make it useful for supporting the container while the contents are poured. Previously it has been necessary to place lids in the correct orientation manually in a stack of lids to be applied to containers by machine. It would be preferable to have the lids automatically oriented properly for application to the upwardly-open containers.

What is needed, therefore, is an improved method for installing lids on upwardly open containers, and a lid installing machine capable of accepting and installing more than a few lids without having to be resupplied with lids, and without causing harmful stress on the machinery dispensing the lids individually to be placed on containers. Such an improved machine should also provide for reliable application of lids without overturning empty containers, and should also have the ability to orient lids automatically to correspond with the location of the bail of a container to which a lid is being applied.

SUMMARY OF THE INVENTION

The present invention overcomes the aforementioned shortcomings and disadvantages of the previously available methods and machinery for applying and fastening resiliently latching lids on upwardly open bucket-like containers, by providing a lid installing and fastening machine which dispenses lids singly from a supply of lids supported in readiness in an inclined stack. Individual lids are supported by, for example, a pair of rails inclined on a shallow slope, with the lids resting on edge, stacked closely together, and the entire stack sliding along the pair of rails toward a dispenser. In a preferred embodiment of the invention each lid is released sequentially into a placement guide position of the machine, in response to the placement of a previous lid upon an upwardly open container.

While each lid is in the placement guide of the preferred embodiment of the invention a rotator orients the lid properly with respect to the normal orientation of containers being conveyed into position for receiving lids. In a preferred embodiment of the invention, the rotator is energized in response to a photosensor which detects the arrival of each lid in the placement guide and then sends a signal which causes actuation of a rotator arm mechanism. The rotator arm then turns reciprocatingly through a predetermined angle to move the spout to the position in which it is to be located at the time the lid is installed.

In order to avoid tipping an empty container as a lid is being pressed into position, a power-driven pressing roller is located above the conveyor carrying the containers. The pressing roller is driven in coordination with the conveyor, so that the surface speed of the pressing roller is the same as the speed of the conveyor carrying a container. The pressing roller frictionally engages the lid and urges it downwardly into latching engagement with the rim of the container as the container is carried beneath the pressing roller by the conveyor at the same speed at which the roller is attempting to advance the lid.

It is therefore a principal object of the present invention to provide an improved lid installing machine capable of reliably dispensing lids and fastening them to containers without tipping the containers.

It is another important object of the present invention to provide an improved lid installing machine capable of placing lids atop containers in a particular orientation.

It is an important feature of the lid installing machine of the present invention that it includes a lid supply magazine which includes a pair of inclined rails on which lids resting on edge can slide with their weight supported primarily by the rails and with a relatively small amount of force being exerted toward a release gate mechanism for releasing individual lids to be applied to containers.

Another important feature of the present invention is the provision of a rotator mechanism which rotates each lid to a desired orientation by reciprocatingly sweeping an arm through an angle defining a sector in which a spout portion of a lid should not be located when the lid is applied to a container.

It is yet a further important feature of the present invention that it provides a powered pressing roller located above a conveyor carrying containers receiving lids, with the surface speed of the pressing roller being equal to the speed of the conveyor, so that lids are pressed into place atop containers without tipping the containers over.

It is an important advantage of the present invention that it results in mounting of lids on containers with less chance of the containers being tipped over.

It is another advantage of the present invention that it provides for application of lids to containers in a required orientation with less manual labor than was previously required.

The foregoing and other objectives, features, and advantages of the invention will be more readily understood upon consideration of the following detailed description of the invention, taken in conjunction with the accompanying drawings.

BRIEF DESCRIPTION OF THE DRAWINGS

FIG. 1 is a side elevational view of a lid installing machine embodying some of the features of the present invention.

FIG. 2 is a diagonal right end view of the apparatus shown in FIG. 1, taken along line 2—2 and showing the lid dispensing gate mechanism of the machine.

FIG. 3 is a view similar to that of FIG. 2, showing the lid dispensing gate mechanism in a different position.

FIG. 4 is a schematic diagram explaining the operation of the mechanism of the lid dispensing gate mechanism shown in FIGS. 1–3.

FIG. 5 is a diagonal right end view of the lid placement guide and lid rotator mechanism of the apparatus shown in FIG. 1, taken along line 5—5.

FIG. 6 is a schematic diagram explaining the operation of the lid rotator mechanism shown in FIG. 5.

FIG. 7 is a simplified view of a conveyor and a power-driven lid pressing roller which embody a portion of the present invention.

DETAILED DESCRIPTION OF THE INVENTION

Referring now to the drawings, in FIGS. 1–3 a lid mounting machine 10 is shown which includes a base 12, supporting a conveyor 14 including a motor 16 moving an endless belt 18 or equivalent endless chain arrangement, which may include upstanding lugs (not shown) to engage containers such as the container 20, to move them in the direction indicated by the arrow 22. The container 20 is equipped with a handle or bail 21, and is located on the conveyor belt 18 with the pivot axis (not shown) of the bail 21 oriented transverse to the direction of movement of the container 20 on the conveyor 14.

Placement of Lids

A supply of lids 24 is supported as an inclined stack supported on a sloping lid supply magazine 25 including structure such as a pair of inclined rails 26. The lower ends of the rails 26 are supported by a frame 28 of a lid dispensing gate mechanism 36 which operates to dispense one lid 24 at a time into a lid placement guide 30.

The lids 24 are generally planar and circular, with each lid including a rim portion 32 which rests upon and slides along the inclined rails 26, which are spaced apart a distance less than the diameter of the lids 24. The lids 24 are in a generally upright orientation as they slide downwardly along the inclined rails 26, which are sloped at a shallow angle 34 of 20° to 40°, and preferably about 25°, with respect to the horizontal. Since the lids are of plastic material they are able to slide downward along the rails 26 as necessary to keep a lid 24 always available, yet with the majority of the weight of each lid supported by the rails 26, and only a smaller, acceptable amount of the weight of the lids being applied to the lid dispensing gate mechanism indicated generally as 36.

Referring now particularly to FIGS. 2 and 3, the gate mechanism 36 is seen to include a pair of pivotably mounted gate arms 38 each including a pair of prongs 40 at one end and a retainer dog 42 located at the opposite end of each arm 38. The prongs 40 are located closer to the inclined stack of lids 24 than are the retainer dogs 42. A respective crank lever arm 44 extends from each of the pivotably mounted gate arms 38 and is pivotably attached to a piston rod 46 of a respective cylinder and piston assembly 48. One end of each cylinder and piston assembly 48 is attached to the frame 28 which supports the gate mechanism 36.

A cylinder and piston assembly 50 is located in an uppermost position in the gate mechanism 36 and operates a retractable dog 52 (FIG. 3) located cooperatively with the retainer dogs 42.

When a container 20 is on the lid mounting machine 10 in the position shown in FIG. 1, the gate mechanism 36 is in the condition shown in FIG. 2, in which the prongs 40 of each of the two pivotably mounted gate arms 38 engage the rim 32 of the lowermost one of the lids 24 supported on the inclined rails 26 of the lid supply magazine 25, and thus prevent movement of the lids 24 along the rails 26.

When a lid 24 held in the lid placement guide 30 is encountered by the top edge of a container 20 being carried along in the direction of the arrow 22 by the conveyor 14, the container 20 pushes the lid 24 against a lid retainer arm 54 which is pivotable about an axis 56 seen in end view in FIG. 1. This raises a counterweight 58 and rotates a cam 60 as the container 20 moves further along the conveyor 14. As the cam 60 rotates it moves a cam-following lever arm 62 of a control switch 64 while the lid 24 is being taken from the lid placement guide 30 by the container 20. The switch 64 operates a relay to initiate movement of the gate mechanism 36 to the condition shown in FIG. 3.

Operation of the gate mechanism 36 is shown in greater detail in FIG. 4, where it will be seen that the switch 64 closes a relay switch 66, energizing a solenoid-operated valve 68 to admit pressurized fluid from a source 69 such as a reservoir of compressed air, to extend the piston of each of the cylinder and piston assemblies 48 and 50. Movement of the pistons rotates each of the pivotably mounted gate arms 38, retracting the prongs 40 from the rim 32 of a lid 24 and moving the retainer dogs 42 and the retractable dog 52 into position ahead of the lid 24 which was previously held by the prongs 40, retaining the lid 24 on the ends of the rails 26, still generally parallel with the other lids remaining on the rails 26.

As the container 20 and its lid 24 move further along the conveyor 14 the retainer arm 54 rides along the top of the lid 24 being carried from the lid placement guide 30, pushing it down loosely onto the container 20. When the container 20 has been carried far enough along the conveyor 14, the retainer arm 54 is free of the lid 24 and returns, urged by the counterweight 58, toward the position shown in FIG. 1. The cam 60 is thus returned to the original position, the relay control switch 64 opens, and the relay switch 66 opens, de-energizing the solenoid, and the valve 68 then returns to the condition shown in FIG. 4. Upon this action of the solenoid-operated valve 68, the pistons of the cylinder and piston assemblies 48 and 50 are again retracted, returning the gate mechanism 36 to the condition shown in FIG. 2. As the gate mechanism 36 returns to the condition shown in FIG. 2 the lid 24 which was being held by the retractable dog 52 and the retainer dogs 42 is released and tips downward into the newly empty lid placement guide 30, as indicated by the arrow 70. At the same time the prongs 40 move inward and engage the next lid 24.

In this manner, each time a lid 24 is taken from the lid placement guide 30 by an advancing container 20 carried on the conveyor belt 18, the gate mechanism 36 cycles to place another lid 24 into the lid placement guide 30, where it is held against sliding out of place by the lid retainer arm 54 until a succeeding container 20 arrives.

Once a lid 24 has been placed atop a container 20, the container and lid together progress along the conveyor 14, passing under an array of rollers 72 which are free to rotate about respective axes extending horizontally, transverse to the direction of movement of the conveyor 14. The rollers 72 are adjustably supported at such heights above the conveyor belt 18 that as the conveyor 14 carries the container 20 and lid 24 in the direction indicated by the arrow 22 the succeeding ones of the rollers 72 are closer to the conveyor belt 18 and force the lid 24 downward into mating engagement atop the container 20, where the lid is held in the well-known manner.

Orientation of Pour Spouts

In the case of lids 24 including pour spouts such as the spout 74 of the lid 24 shown in FIG. 5, it is desired that the spout 74 be located 90 degrees away from the location of the pivotable attachment point of either end of the bail 21, in order to facilitate pouring liquid contents from the container 20. Since the containers 20 are placed upon the conveyor 14 in a predetermined orientation, it is necessary only to orient each of the lids 24 to a predetermined orientation within the placement guide 30 to accomplish attachment of the lid 24 to the container 20 in a preferred orientation. To this end, a rotator mechanism indicated generally at 76 is attached to the lid placement guide 30 as shown in FIG. 5. In the embodiment of the invention shown, this location is on the underside of the lid placement guide 30 shown in FIG. 1.

A lid sensor, preferably a photosensor 78, is mounted in a position as shown in FIG. 1 relative to the lid placement guide 30, where it is able to detect whether or not a lid 24 is present in the lid placement guide 30.

Referring now to FIG. 5, the rotator mechanism 76 includes a support 80 fixedly attached to the lid placement guide 30. A rotator arm 82 is fixedly mounted on a shaft 84 to which a crank arm 86 is also attached. The shaft 84 is rotatably supported by the support piece 80. A double-acting cylinder and piston assembly 88 is supported by the lid placement guide 30 and a piston rod 90 thereof is pivotably attached to the outer end of the crank arm 86, so that extension and contraction of the cylinder and piston assembly 88 causes rotation of the crank arm 86 and resultant rotation of the rotator arm 82. A switch actuator arm 92 is adjustably attached to the piston rod 90 so as to push a button to open the contacts of a switch 94 when the cylinder and piston assembly 88 has been contracted to move the piston rod 90 in the direction of the arrow 96 to an appropriate position.

The shaft 84 is attached to a central location on the rotator arm 82. The location of the support 80 is chosen so that the shaft 84 is centrally located with respect to the location of a lid 24 held ready within the lid placement guide 30. A pair of opposite end pieces 98, 99 of the rotator arm 82 each rotate through an angle determined by the length of the stroke of the piston rod 90. The length of the stroke of the piston rod 90 is chosen so that each time presence of a lid 24 in the lid placement guide 30 is detected by the photosensor 78 the piston and cylinder assembly will be operated once in each direction, and the end pieces 98, 99 of the rotator arm will sweep through a predetermined angle once in each direction to ensure that the spout 74 of the lid 24 is not located within the swept sectors of the circle normally occupied by a lid 24.

Thus, as shown in FIG. 5, with the piston rod 90 being retracted, moving in the direction indicated by the arrow 96, the upper right end piece 98 of the rotator arm 82 is resting against a side of the spout 74 and is rotating the lid 24 in the direction indicated by the arrow 100. Ultimately, when the switch actuator arm 92 reaches the switch 94, the end piece 98 will have reached the position shown in broken line and the spout 74 will be at the position indicated at the bottom of FIG. 5 in broken line, 90° away from either of the pivotal attachment points of the bail 21 of a container 20 oriented as shown in FIG. 1.

Once the switch 94 is actuated by the actuator arm 92, the cylinder and piston assembly 88 extends, the piston rod 90 then pushing the crank arm 86 downward as seen in FIG. 5, returning the lower left end piece 99 of the rotator arm 82 to the position shown in dashed line to the left of the phantom line depiction of the spout 74.

The spouts 74 include portions which project a short distance generally normal to the plane of the lids 24, thus usually having an end extending toward the interior of the container 20, so that the container can be stacked. Should a lid 24, when dispensed by the gate mechanism 36 into the lid placement guide 30, have its spout 74 falling against the surface of the end piece 98 of the rotator arm 82, the end piece 98 will slide off the end of the spout area 74 when moving in one direction, and will encounter the side of the spout 74 when returning to its position with the piston and cylinder assembly 88 fully extended, thus rotating the lid 24 to the desired orientation on the return stroke of the cylinder and piston assembly 88. In order to slide easily off the projecting end of a spout 74, the end pieces 98, 99 of the rotater arm 82 are preferably of a low-friction material such as a PTFE-type plastic.

Referring also to FIG. 6, the operation of the lid rotator mechanism 76 will be more fully understood. The lid sensor 78 may be an optical scanner of a type operable in a proximity mode, which provides an electrical signal in response to sensing an object in suitable proximity, as when a lid 24 is initially dispensed into the lid placement guide 30. The signal from the photosensor 78 is transmitted to a one-shot pulse generator 102 which momentarily closes the normally open contacts of a relay switch 104, as well as the normally open contacts of a latching relay switch 106 which then becomes the path for current to maintain the contacts of the relay switch 104 in a closed condition so long as the switch 94 remains closed. Closure of the relay switch 104 energizes the solenoid of the solenoid-operated valve 108, which then directs fluid pressure from a pressure source 110 such as a reservoir of compressed air to retract the cylinder and piston assembly 88 until the switch actuator arm 92 carried on the piston rod 90 opens the switch 94. Opening the circuit through switch 94 opens the latching relay switch 106 and thereby permits the relay switch 104 to open. When the relay switch 104 opens, the solenoid-operated valve 108 returns to its normal position, directing fluid pressure so as to return the cylinder and piston assembly 88 to an extended position. Thus, each time the lid sensor 78 senses a lid 24 coming into place in the lid placement guide 30, the solenoid-operated valve 108 is energized long enough to cycle the cylinder and piston assembly 88 in each direction far enough to turn the crank arm 86, and thereby rotate the rotator arm 82, so that each of the ends 98 of the rotator arm sweeps through a predetermined angle. This moves a spout 74 of a lid 24 to the predetermined orientation with repect to the lid placement guide 30, so that the lid 24 will be properly oriented with respect to the bail 21 of the container 20 on which it is to be placed.

Lid Pressing Roll

Referring now to FIG. 7, another important aspect of the invention is the provision of a generally cylindrical pressing roll 112 which is driven to rotate about an axis of rotation 122 in coordination with the conveyor 14. Endless flexible power transmission devices such as belts 114, 116, and 118 cause the lowermost portion of the outer surface of the pressing roll 112 to move in the same direction as the conveyor belt 18, and at the same surface speed. Preferably, the pressing roll 112 has an outer surface layer 120 of a resilient material such as rubber, which may have a surface texture including grooves defined therein, in order to engage the lid 24 frictionally. The height of the axis of rotation 122 above the conveyor 14 is adjusted so that the roll 112 forces the lid 24 downward into latching relationship with the top edge of the container 20 as the container 20 and the lid 24 are both moved in the direction indicated by the arrow 22 at the same speed by the conveyor and the pressing roll 112. Preferably, the axis 122 is parallel to the axes of the drive rolls of the conveyor 14, or in other words, the axis of rotation 122 is horizontal and transverse to the direction of movement of the container 20 indicated by the arrow 22.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. Lidding apparatus for placing circular lids, each including a projecting spout structure defining a pour spout location, in a preferred orientation on upwardly open containers, comprising:

(a) means for holding a supply of lids;

(b) lid gate means for releasing said lids one at a time from said means for holding a supply of lids; and (c) lid placement guide means for orienting each said lid relative to a respective container, said lid placement guide means including rotatable lid rotator means for engaging said projecting spout structure of each said lid and, by rotation of said rotator means while engaging said spout structure, rotating said lid to said preferred orientation.

2. Lidding apparatus for placing circular lids, each including a projecting structure defining a pour spout location, in a preferred orientation on upwardly open containers, comprising:

(a) means for holding a supply of lids;

(b) lid gate means for releasing said lids one at a time from said means for holding a supply of lids; and (c) lid placement guide means for orienting each said lid relative to a respective container, said lid placement guide means including lid rotator means for engaging said projecting sturcture of each said lid and thereby rotating each said lid to said preferred orientation, said lid placement guide means including lid sensor means for detecting the presence of a lid in proximity to said lid placement guide means, and actuator means for actuating said lid rotator means in response to said lid sensor means detecting the presence of a lid, said lid placement guide means defining a lid receiving location and said lid rotator means including a rotator arm mounted for rotation, about an axis of rotation located concentrically with respect to said lid-receiving location of said lid placement guide means, and said lid rotator means including (i) a crank connected drivingly to said rotator arm;

(ii) a cylinder-and-piston assembly connected drivingly to said crank;

(iii) an electrically-controlled valve connected to a source of pressurized fluid so as to control a flow of said fluid to said cylinder-and-piston assembly; and (iv) a relay, responsive to said lid sensor means and connected controllingly to said electrically-controlled valve.

3. The apparatus of claim 2 wherein said relay is a latching relay, said rotator means further including switch means responsive to movement of said cylinder-and-piston assembly for releasing said latching relay upon a predetermined amount of movement of said cylinder-and-piston assembly.

4. A method for placing circular lids, each including a projecting spout structure defining a pour spout location, in a preferred orientation on upwardly open containers, comprising:

(a) providing a supply of lids;

(b) releasing said lids one at a time into a lid placement guide;

(c) reciprocatingly swinging a rotator arm in each direction through a predetermined arc in a plane located parallel with each lid while said lid is being held in said lid placement guide; and (d) while swinging said rotator arm, engaging said projecting spout structure of the lid by means of said rotator arm and thereby rotating said lid as necessary to leave said projecting spout structure thereof in a predetermined sector, with respect to said lid placement guide, outside the predetermined arc through which said rotator arm was swung; and (e) thereafter placing said lid atop a respective container.

5. Lidding apparatus for placing circular lids, each including a projecting structure defining a pour spout location, in a preferred orientation on upwardly open containers, comprising:

(a) means for holding a supply of lids;

(b) lid gate means for releasing said lids one at a time from said means for holding a supply of lids; and (c) lid placement guide means for orienting each said lid relative to a respective container, said lid placement guide means including lid rotator means for engaging said projecting structure of each said lid and thereby rotating each said lid to said preferred orientation, said lid placement guide means including lid sensor means for detecting the presence of a lid in proximity to said lid placement guide means, and actuator means for actuating said lid rotator means in response to said lid sensor means detecting the presence of a lid, and said lid placement guide means defining a lid receiving location, and said lid rotator means including a rotator arm mounted for rotation, about an axis of rotation located concentrically with respect to said lid-receiving location of said lid placement guide means, and including a pair of opposite ends located on opposite sides of said axis of rotation, and said actuator means comprising motor means for rotating said rotator arm through a predetermined angle of rotation in each direction about said axis of rotation.

6. Lidding apparatus for placing circular lids, each lid including a projecting structure having an end and defining a pour spout location, in a preferred orientation on upwardly open containers, comprising:

(a) means for holding a supply of lids;

(b) lid gate means for releasing said lids one at a time from said means for holding a supply of lids; and (c) lid placement guide means for orienting each said lid relative to a respective container, said lid placement guide means including lid rotator means for engaging said projecting structure of each said lid and thereby rotating each said lid to said preferred orientation, said lid placement guide means including lid sensor means for detecting the presence of a lid in proximity to said lid placement guide means, and actuator means for actuating said lid rotator means in response to said lid sensor means detecting the presence of a lid, said lid placement guide means defining a lid receiving location, and said lid rotator means including a rotator arm mounted for rotation, about an axis of rotation located concentrically with respect to said lid-receiving location of said lid placement guide means, and said actuator means comprising motor means for rotating said rotator arm through a predetermined angle of rotation, said rotator arm including low-friction surface means located at an end thereof for sliding off said end of said projecting structure in order to engage said projecting structure laterally and rotate said lid to said preferred orientation.

* * * * *

UNITED STATES PATENT AND TRADEMARK OFFICE

CERTIFICATE OF CORRECTION

PATENT NO. : 4,683,706

DATED : August 4, 1987

INVENTOR(S) : Chester H. Harper

It is certified that error appears in the above-identified patent and that said Letters Patent is hereby corrected as shown below:

On the title page assignee should read

--(73) Assignee: Allen Fruit Co., Inc. --.

Signed and Sealed this

Twelfth Day of April, 1988

*Attest:*

DONALD J. QUIGG

*Attesting Officer*

*Commissioner of Patents and Trademarks*